United States Patent [19]

McWhorter et al.

[11] 4,398,410

[45] Aug. 16, 1983

[54] AUTOMOTIVE FRAME AND BODY CORRECTING EQUIPMENT

[75] Inventors: Fred A. McWhorter, Davenport; Samuel R. Harmon, Clinton, both of Iowa

[73] Assignee: Bee Line Company, Bettendorf, Iowa

[21] Appl. No.: 284,161

[22] Filed: Jul. 17, 1981

[51] Int. Cl.[3] ..... B21D 1/12

[52] U.S. Cl. ..... 72/457; 72/705

[58] Field of Search ..... 72/705, 457

[56] References Cited

U.S. PATENT DOCUMENTS

| | | | |
|---|---|---|---|
| 3,777,541 | 12/1973 | Whitney | 72/705 |
| 3,999,419 | 12/1976 | Larson et al. | 72/705 |
| 4,055,061 | 10/1977 | Bayorgeon et al. | 72/705 |
| 4,070,899 | 1/1978 | Venalainen | 72/705 |
| 4,262,519 | 4/1981 | Mason | 72/705 |
| 4,291,570 | 9/1981 | Whitney | 72/705 |
| 4,313,335 | 2/1982 | Eck | 72/705 |
| 4,367,569 | 1/1983 | Harmon | 24/211 P |

FOREIGN PATENT DOCUMENTS

| | | | |
|---|---|---|---|
| 2739528 | 3/1979 | Fed. Rep. of Germany | 72/705 |

*Primary Examiner*—Lowell A. Larson

*Attorney, Agent, or Firm*—Henderson & Sturm

[57] ABSTRACT

Disclosed is automotive frame and body correcting equipment having a main bed or frame for supporting a motor vehicle while correcting operations are performed. The underside of the bed has a rectilinear track therein about which one or more correcting accessories may be selectively positioned. Such accessory, here in the form of a pulling tower, is equipped with rollers for riding over the bed, and the tower is further moved inwardly and outwardly generally crosswise of the track and is capable of being positioned at various angles about a vertical pivot. The tower has a base that follows the track and an upright tower part that is selectively adjustable among several positions angularly spaced about a horizontal axis, whereby the versatility of the equipment is improved.

7 Claims, 7 Drawing Figures

18
28
32
16
84
80
78
22
44
40
70
66
50
58
54
44
68
36
34
46
70
32
20
10

AUTOMOTIVE FRAME AND BODY CORRECTING EQUIPMENT

BACKGROUND OF THE INVENTION

Equipment of the general character defined herein is well known, and typical equipment consists of a horizontal bed on which a motor vehicle can be positioned for correction by a variety of tools, customarily hydraulically powered. A significant amount of correcting is accomplished by attaching a flexible member, such as a chain, to the damaged part of the vehicle, and the chain is pulled by a hydraulic cylinder anchored to the bed. It is important in these types of operation that the line of pull be relatively accurately maintained and it is known to provide for selective positioning of the pulling device on the bed so that the proper angle can be selected for the type of pull being made. In at least one known form of equipment, the bed has rounded or semi-circular ends and straight sides to provide a track which can be followed by a correcting tool, such as a pulling tower. This enables easy positioning of the tower, and means is provided for locking it in any selected position.

BRIEF DESCRIPTION OF THE INVENTION

According to the present invention, the bed is formed as a rectangle having two long straight sides and two short straight ends. A track of rectilinear form is provided in the under surface of the bed inwardly of the perimeter of the bed. One or more correction accessories, such as pulling towers, can follow the track 360° about the bed perimeter. This is made possible by mounting the accessory on a base which is in turn connected to a track follower. The connection of the base to the track follower is such that, although the base must follow the track according to the follower, it can be moved relative to the follower in opposite directions generally transverse to the stretch of track. This enables an increase in horizontal distance between the base and the track so that the base can be swung to various positions about an upright axis and, furthermore, this provision enables the base to turn the square corners of the bed without the need for rounding the corners or providing the ends of the beds as part-circles.

It is a further feature of the invention that the correction accessory base may be selectively locked in a variety of angular positions to achieve the proper pulling angle. Additionally, the tower part of the accessory is mounted on the base for angular movement relative to the base about a horizontal axis, thus improving the versatility of the accessory in the accomplishment of still further adjusted position.

Another feature of the invention is that the track, at each of its short stretches or paths, is extended beyond its intersection with the long part of the track. This enables the accessory to be moved additionally outwardly on the bed for providing still further pulling positions. Retractible stop or switch means is provided for causing the track follower to turn the corner or, selectively, to run out into the track extension.

DETAILED DESCRIPTION OF THE DRAWINGS

Figure 1:
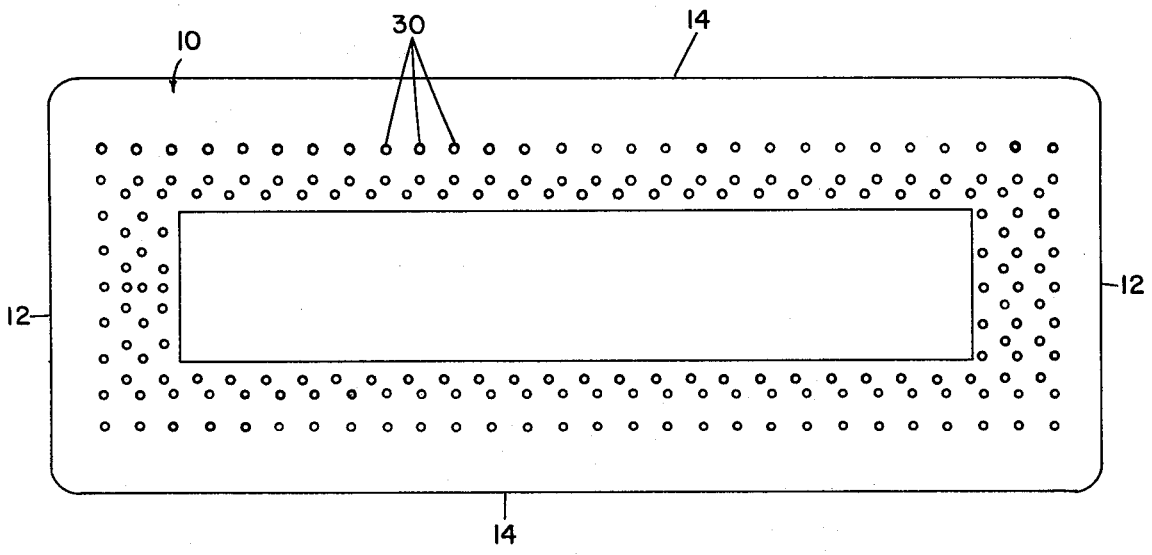
FIG. 1 is a top plan of the bed, drawn to a reduced scale.
Figure 2:
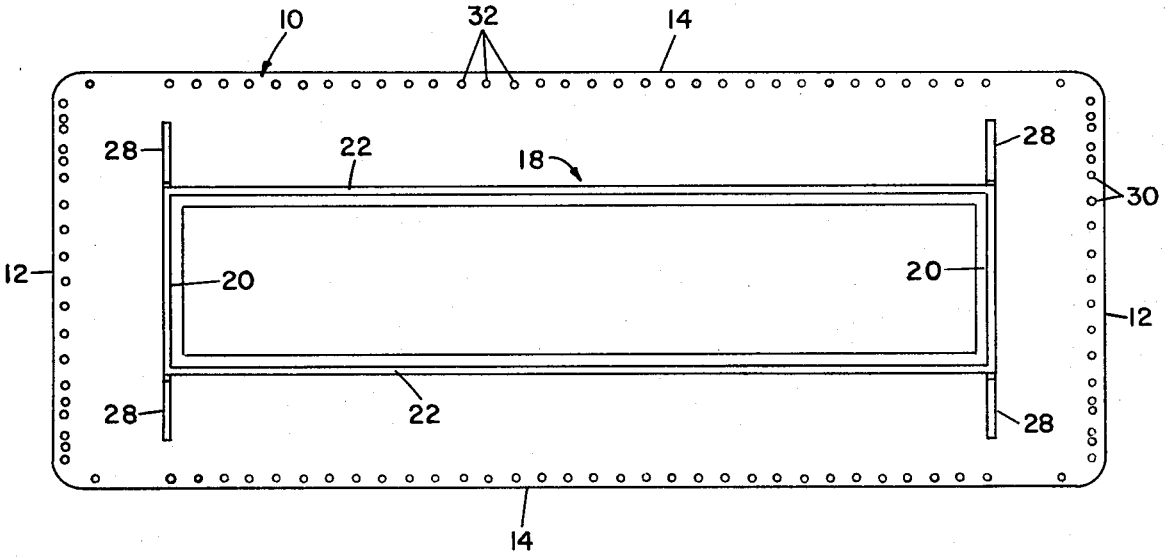
FIG. 2 is a bottom view of the bed, on the same scale, showing particularly the track means.
Figure 6:
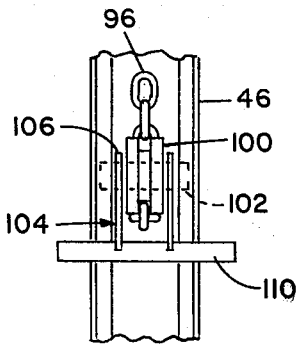
FIG. 6 is a fragmentary end view as seen along the line 6—6 on FIG. 3.
Figure 3:
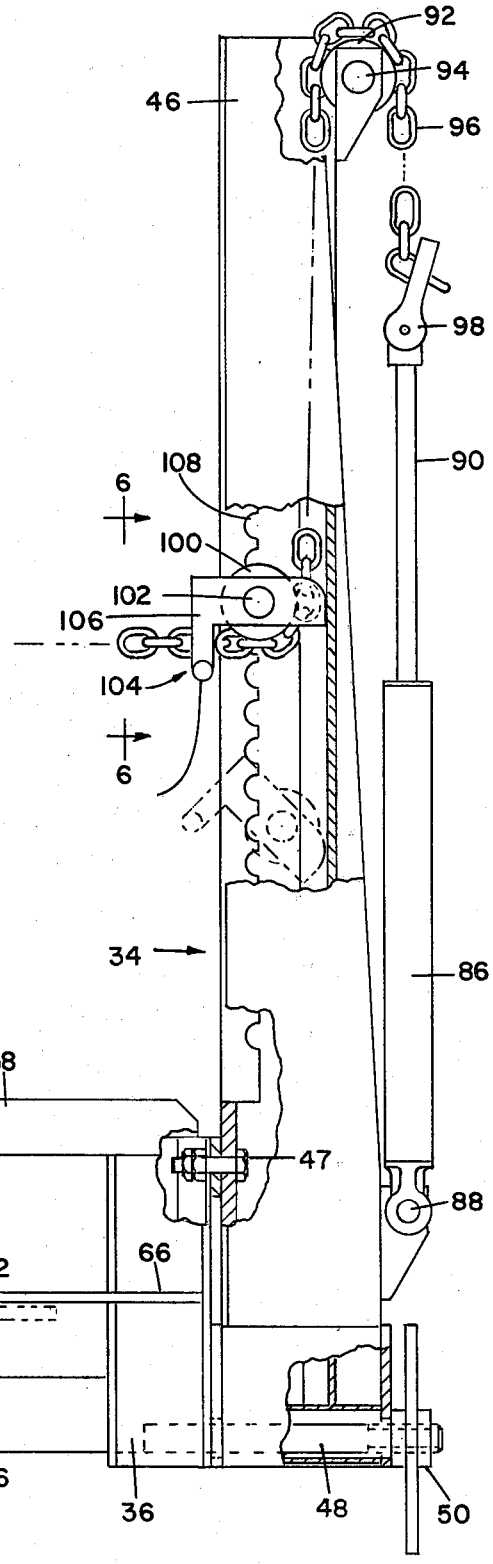
FIG. 3 is an enlarged view, partly in section and with parts broken away, of a correction accessory and its relation to the bed and track.

FIGS. 1 and 2 show that the bed, designated in its entirety by the numeral 10, is of rectilinear form, having two short straight sides or ends 12 and two long straight sides 14. The bed is preferably formed of upper and lower steel plate material peripherally united by one or more steel channels 16 (FIG. 3). The underside of the bed has provided therein a rectilinear track 18 having two short straight ends or sides 20 and two long straight sides 22. As best seen in FIG. 3, the track may be established by structural steel members such as a channel 24 and a related member 26, all united by welding or equivalent means. FIG. 2 best shows that each short portion or stretch 20 of the track is extended at opposite ends by track extensions 28. Each extension runs beyond the intersection or corner of the track, for purposes to appear later herein. The upper and lower surfaces of the bed are provided with series or plurality of holes 30 and 32 to provide for attachment of various types of accessories and for selective positioning of such accessories.

Figure 5:
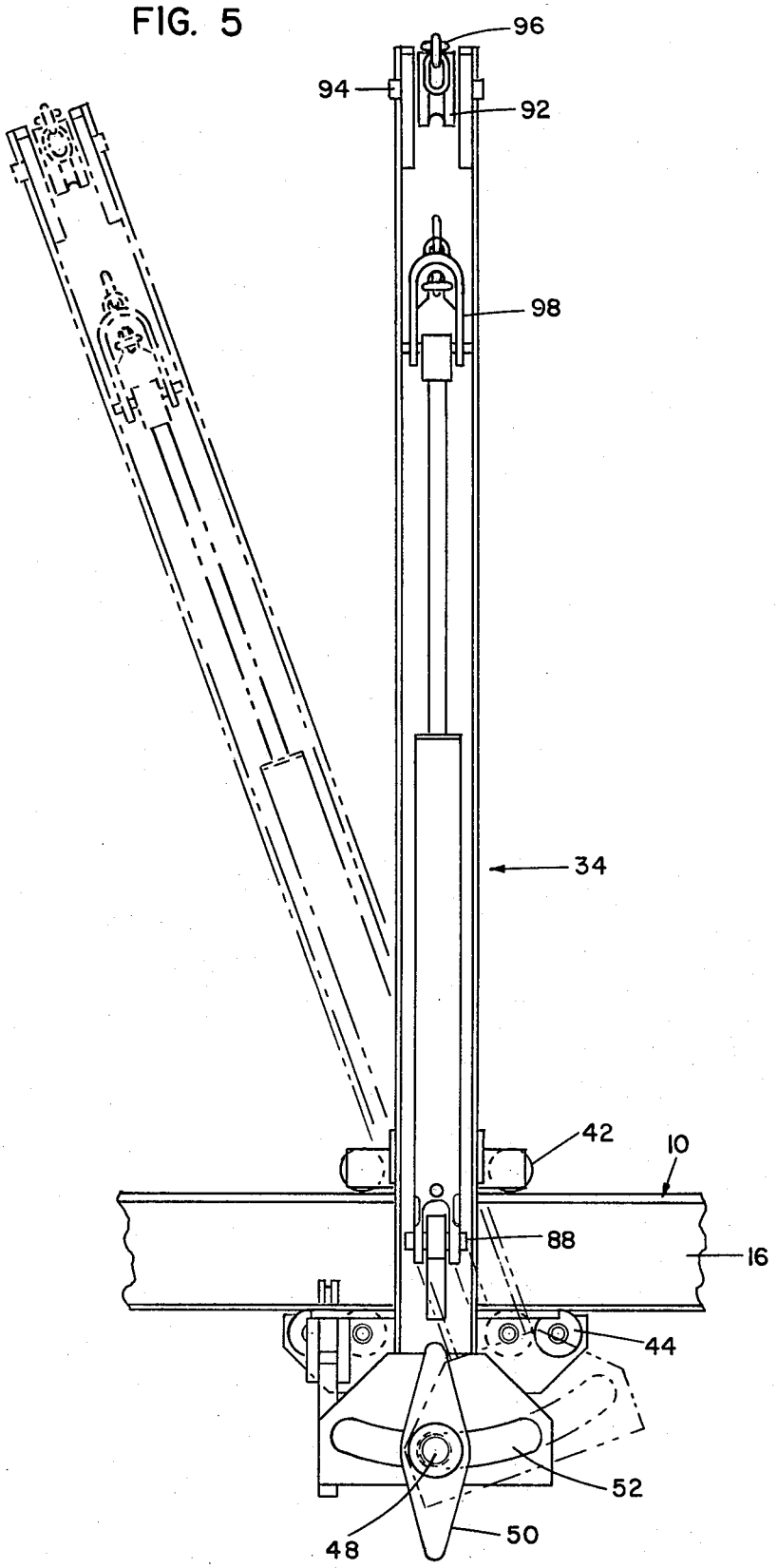
FIG. 5 is an end elevation of the structure shown in FIG. 3, indicating in broken lines one of the angular positions.

The correction accessory (of which there may be several) chosen for illustration is here of the type known as a pulling tower and is denoted in general at 34. As seen best in FIG. 3, the tower has a base 36 of structural steel of generally U form, having rigid therewith upper and lower legs 38 and 40 which respectively lie over and under the bed 10. These legs respectively have rollers 42 and 44 for supporting the base for travel about the periphery of the bed. The tower further has an upright element 46 pivoted to the base on a horizontal axis at 47 and lockable by a threaded member 48 welded to the base and projecting outwardly through the lower end of the upright element to receive a wing nut 50. The lower end of the element has an arcuate slot 52 therein for guiding the element for angular movement about the axis of the member 47 to enable selection of different angular positions when the wing nut is loosened (broken lines FIG. 5). The preferable range of adjustment is about 20° to both sides of the vertical. As will appear subsequently, this adjustment enables "fine tuning" of the angular position of the tower as to the line of pull with respect to the vehicle being worked on.

Figure 4:
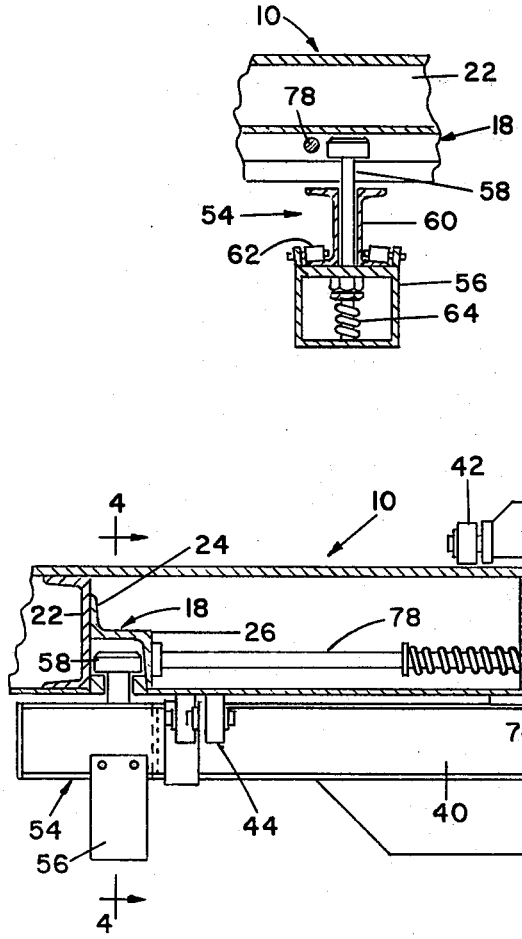
FIG. 4 is a "slice" section as seen along the line 4—4 of FIG. 3.
Figure 7:
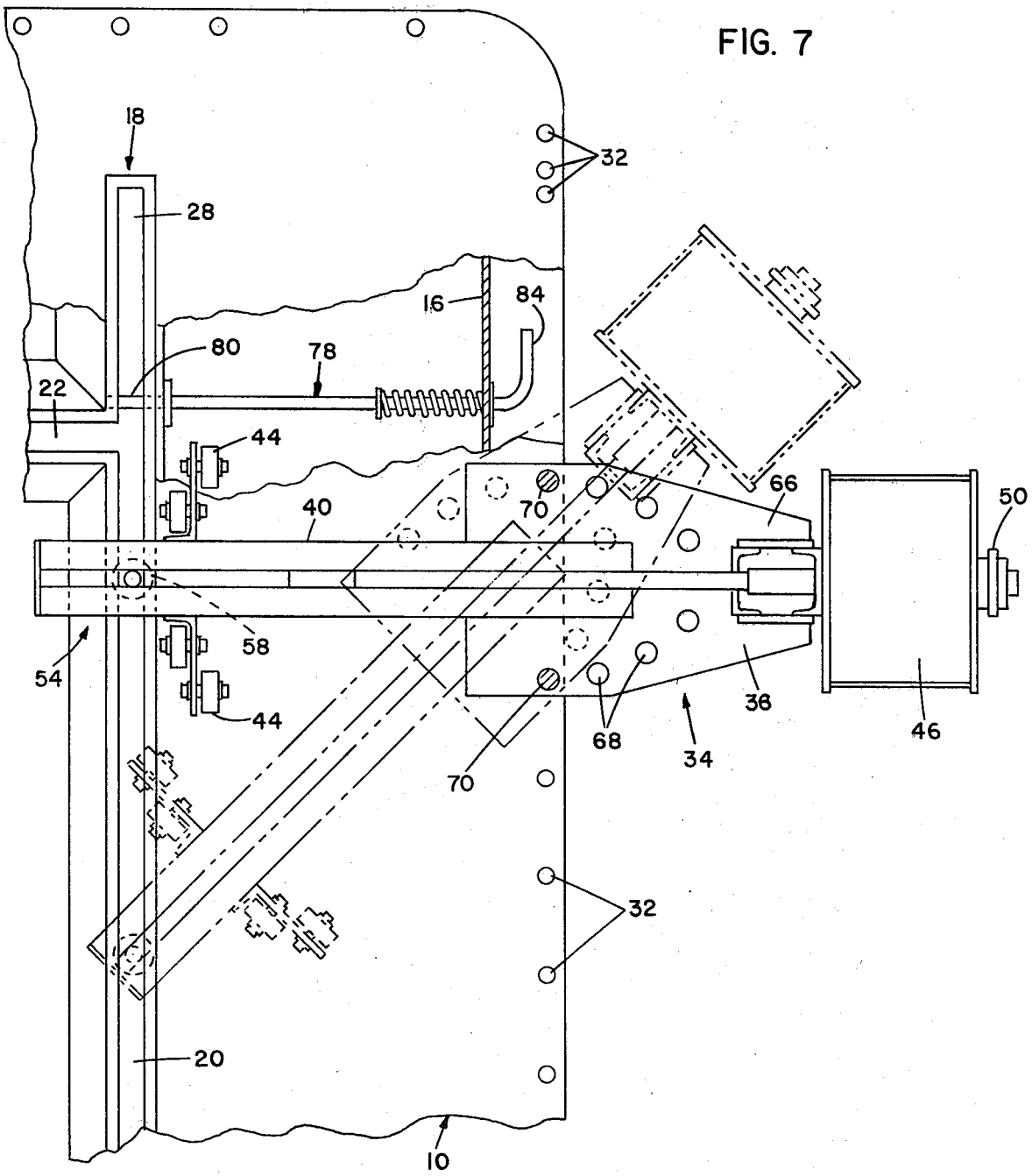
FIG. 7 is a bottom view of the structure shown in FIG. 3, again the broken lines indicating an angled position of the correcting accessory or pulling tower.

The pulling tower is caused to follow the track 18 by means of track follower means 54 (FIGS. 3, 4 and 7). This means includes an undercarriage 56 having an upright headed follower pin 58 which rides in the track 18. The lower leg 40 of the tower is extended as a channel 60 equipped with rollers 62 by means of which the tower can be moved inwardly and outwardly relative to the follower means while the headed pin 58 remains in the track. A coiled spring 64 serves to maintain the proper rolling relationship of the carriage to the leg and prevents the head of the pin 58 from dragging in the track. The purpose of the in-and-out movement of the base crosswise of the adjacent track portion is illustrated in FIG. 7 where the tower is shown as having a bottom plate 66 provided with two arcuate rows of holes 68. A locking pin 70 is received in one of the holes 68 in the plate and in one of the holes 32 lined up therewith, and a second such pin is received in a pair of alined holes 32 and 68 at the opposite side of the tower centerline. The full lines in FIG. 7 show the tower as being locked "square" with the bed; that is, its horizontal centerline lengthwise of the base is normal to the adjacent track portion or parallel to the fore-and-aft direction of the length of the bed. The broken lines show how the pins 70 may be removed and replaced in different sets of holes to achive angular positioning of the tower with respect to a vertical axis. In the preferred embodiment, the holes 68 are arranged to give the tower selectively angular positions of 5°, 30° and 45° at both sides of center.

When the tower is positioned in an angular position, the distance between the base 36 and track is increased, but this is accommodated by the lost-motion connection of the base to the track follower by the means shown best in FIG. 4; that is, the leg and base can move in or out while the track follower remains in the track. The same type of motion enables the tower to turn the square corners of the bed. The locking pin 70 may be of the type having a T head 72 and a cam lock 74 operated by a handle 76, which functions to tightly lock the tower to the bed without any lost motion.

The specific lock means 72, 74, 76 forms no part of the present invention and may be replaced by any suitable means. That shown here forms the subject matter of Assignee's U.S. Pat. No. 4,367,569. When the handle 76 is turned to the dotted line position of FIG. 3, the pin 70 may be removed.

The function of the track extensions 28 will now be described and reference will be had primarily to FIG. 7. A spring-loaded locking means 78 is carried for in-and-out movement on the peripheral portion of the bed, and when in its inward position blocks the track extension as seen at 80. It will be understood that there is a similar locking means at each of the four corners of the track. When the lock is shown in FIG. 7, it blocks off the track extension 28 and prevents the track follower pin from entering the track extension. Thus, the tower may easily turn the corner without the necessity of manually preventing the headed pin from entering the extension. When, however, it is desired to position the tower laterally outwardly of the long side 22 of the track, as when exerting a pull close to the long edge of the bed, the lock 78 is retracted manually and has a handle portion 84 which can be hooked over the adjacent portion of the channel 16 when the lock is turned about ninety degrees. This retracts the blocking portion 80 from the track extension, and the tower may be moved outwardly. The range of the holes is such that the tower may be locked in selected outer positions.

The tower includes force-exerting means for the application of pulling forces to the damaged parts of the vehicle being repaired. In the present case, this means includes a hydraulic cylinder 86 anchored to a lower part of the tower at 88 and including a piston rod 90. A sheave 92 is journaled on a shaft 94 at the top of the tower and a flexible element such as a chain 96 is connected to the end of the piston rod at 98 and is trained over the sheave, extending downwardly to another sheave 100 which is journaled on a shaft 102 carried by adjustable means 104. This means comprises a carrier 106 in the form of an inverted L, and the shaft 102 may be selectively engaged with any one of a plurality of vertically spaced notches 108 provided within the tower. The depending part of the member 106 has a handle 110 for manipulating the means 104 to change positions. In a preferred construction, the tower is a steel channel opening toward the bed and the interior walls of the channel are provided with a pair of spaced apart plates which have the notches 108. The chain extends toward the bed for connection to a vehicle (not shown) and, as long as the pulling force is exerted by the cylinder, the shaft 102 cannot escape from its selected notches. When it is desired to change the vertical position of the sheave 100, so as to exert a higher or lower pull than that illustrated, the pulling force is relaxed to loosen the chain and the handle 110 is raised so that the shaft 106 can move rearwardly (to the right as seen in FIG. 3) and out of the notches, after which the sheave carrier can be positioned as desired and the handle rocked counterclockwise to the position shown in FIG. 3 which again locks the selected position.

It will be seen from the foregoing that vastly improved equipment has been provided. The pulling tower or its equivalent is extremely versatile as to angular positioning, being changeable about the vertical axes 32–70 and also about the horizontal axis at 48. The tower may be positioned as desired 360° about the perimeter of the bed. It may also be switched into the track extensions for still greater flexibility and versatility. Features and advantages not specifically described will occur to those versed in the art, as will many modifications and alterations in the preferred embodiment of the invention disclosed, all without departure from the spirit and scope of the invention.

We claim:

1. Automotive frame and body correcting equipment comprising: a generally horizontal bed having upper and lower surface portions and a rectilinear perimeter providing four straight sides and four substantially square corners; a correcting accessory having a base of generally U-form including an upper leg extending inwardly over the bed upper surface portion, a lower leg extending inwardly under the bed lower surface portion and a bight joining the legs together outwardly of the bed perimeter; means supporting the base on at least one of its legs for horizontal movement of the base relative to the bed; means at one of the surface portions providing a continuous rectilinear track spaced relatively closely inwardly of the bed perimeter and including four straight paths and four substantially square corners; at least one of the straight track paths having a straight track extension beyond a track corner at which said one straight path meets its neighboring straight track path; track follower means engaging the track for movement along and about the track and selectively into and out of said track extension; means interconnecting the track follower means and one of the accessory legs for causing the accessory to follow the follower means about the track, said interconnecting means including a pair of interengaged members connected respectively to the one leg and to the track follower means for movement relative to each other lengthwise of said one leg to enable variations in the horizontal distance between the track follower means and the accessory bight.

2. Automotive frame and body correcting equipment according to claim 1, in which stop means is disposed on the bed adjacent to the track corner beyond which the track extension extends and means mounts the stop means for selective movement from a blocking position preventing entry of the track follower means into the extension to an unblocking position enabling entry of the track follower means into said extension.

3. Automotive frame and body correcting equipment according to claim 2 in which: the stop means is so arranged that when it is in its blocking position it guides the track follower means around said track corner.

4. Automotive frame and body correcting equipment according to claim 1, in which: a similar track extension is provided at the other three corners of the track.

5. Automotive frame and body correcting equipment according to claim 1, in which the accessory includes an upright member rising from the base; means connecting the member to the base for angular movement relative to the base about a generally horizontal axis transverse to the associated edge of the bed; and means for selectively holding the member in either one of at least two angular positions about said horizontal axis.

6. Automotive frame and body correcting equipment according to claim 1, in which the track is formed in the lower surface portion of the bed and is generally of T-shape in cross section; and the track follower means is connected to the lower leg of the accessory and is configured to ride in and follow the track.

7. Automotive frame and body correcting equipment according to claim 1, in which the means supporting the base on the bed includes upper roller means on the upper accessory leg engageable with the bed upper surface portion and lower roller means on the lower leg and engageable with the bed lower surface portion.

* * * * *